United States Patent [19]

Carbone et al.

[11] Patent Number: 4,521,760

[45] Date of Patent: Jun. 4, 1985

[54] MINIATURIZED CIRCUIT BREAKER

[75] Inventors: Douglas C. Carbone, Wells; Philip J. Dennis, Cape Elizabeth, both of Me.

[73] Assignee: GTE Products Corporation, Stamford, Conn.

[21] Appl. No.: 533,184

[22] Filed: Sep. 19, 1983

[51] Int. Cl.[3] ..... H01H 37/12; H01H 37/54

[52] U.S. Cl. ..... 337/368; 337/372; 337/375

[58] Field of Search ..... 337/67, 82, 93, 89, 337/102, 107, 112, 347, 349, 362, 365, 372, 374, 375, 380, 368

[56] References Cited

U.S. PATENT DOCUMENTS 3,587,022 6/1971 Hire ..... 337/94

*Primary Examiner*—Harold Broome

*Attorney, Agent, or Firm*—James Theodosopoulos

[57] ABSTRACT

A circuit breaker comprises a two piece metal enclosure, a cover and a base. Disposed within the enclosure is a PMB bimetal which is fastened to a step in the cover. The opening time of the circuit breaker can be adjusted by means of the step.

2 Claims, 2 Drawing Figures

MINIATURIZED CIRCUIT BREAKER

This invention concerns electrical circuit breakers of the type employing a positive make and break (PMB) bimetal, such as is shown in U.S. Pat. No. 2,585,068. Such a PMB bimetal comprises a cantilever section fastened to a U shaped segment. The circuit breaker construction disclosed in said patent does not permit calibration of the PMB bimetal after enclosure in a container.

This invention discloses a circuit breaker comprising a PMB bimetal within a suitable container which permits calibration of the PMB bimetal after enclosure thereof in the container. In addition, the construction of the circuit breaker permits great miniaturization thereof so as to enable use of the circuit breaker in a small space, such as in a motor bursh card.

A circuit breaker in accordance with this invention comprises a two piece metal enclosure, the two metal components of the enclosure being the electrical terminals and being insulated from each other. Within the enclosure there is a stationary contact on the base terminal and a PMB bimetal, one end of the cantilever section of which is fastened to a step in the cover terminal. The other end of the PMB bimetal has a contact for making electrical contact with the stationary contact.

Figure 1:
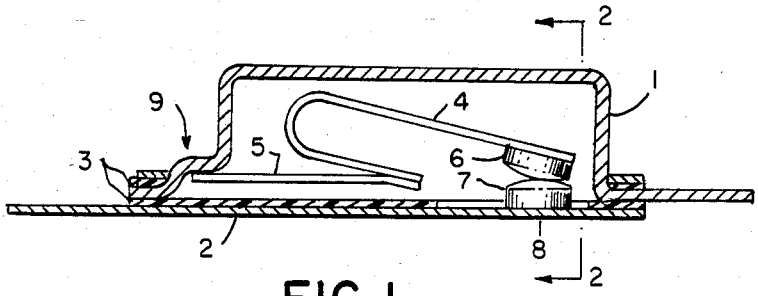
Figure 2:
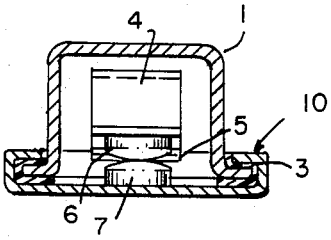

In the drawing, FIG. 1 shows a cross-sectional side view of a circuit breaker in accordance with this invention and FIG. 2 is a sectional end view thereof.

As shown in the drawing, one embodiment of a circuit breaker in accordance with this invention comprises a metal cover 1 and a base section 2. Base section 2 is crimp formed (shown at 10 in FIG. 2) around rim 11 of cover 1 with insulation 3 therebetween, thereby maintaining electrical insulation between base section 2 and cover 1, and forming a semi-hermetic seal. The end of cantiliver section 5 of PMB bimetal 12 is fastened, for example, by welding, to a step 9 in cover 1. Fastened to the other end of cantilever section 5 is U shaped segment 4 of PMB bimetal 12. A contact 6, which is movable, is welded to the end of U shaped segment 4 and, when the circuit breaker is closed, makes electrical contact with a fixed contact 7 which is welded to base section 2.

PMB bimetal 12 provides positive make and break action and is less susceptible to ambient temperatures because of its construction, which is as follows. The upper surface of cantilever section 5 in FIG. 1 is the high expansion layer of the bimetal and the lower surface is the low expansion layer. For U shaped segment 4, the high expansion layer is the inner surface of the U and the low expansion layer is the outer surface. Thus, if the ambient temperature increases, the right hand end of cantilever section 5 will tend to move down towards base section 2, while U shaped segment 4 will tend to open up, that is, try to move contact 6 away from contact 7.

In one example, a circuit breaker in accordance with this invention was 0.35 inches wide by 0.19 inches high by 0.58 inches long, excluding the terminals, and 0.98 inches long, including the terminals. Cover 1 was made of 15 mil cold rolled steel, copper coated. Step 9 was 230 mils wide, the same width as the cavity portion of cover 1, by 65 mils long by 40 mils deep. Base section 2 was made of 10 mil cold rolled steel, copper coated. Insulation 3 was made of 10 mil mylar. Cantilever section 5 was 300 mils long by 75 mils wide and was made of 6 mil Type 6650 bimetal. Segment 4 had an overall length of 600 mils (before bending into a U) by 150 mils wide and was also made of 6 mil Type 6650 bimetal.

The calibration is performed as follows. Say the circuit breaker is required to open within 10 to 20 seconds at a current of 9 amps. The circuit breaker is placed in a suitable apparatus which applies 9 amps and starts timing. If the circuit breaker has not opened by 20 seconds, the apparatus immediately places a probe, the end of which measures about 100 mils by 50 mils, on the outer edge of step 9 and starts applying pressure, thereby slightly deforming the metal cover and rocking the PMB bimetal, until the circuit breaker opens.

If the circuit breaker opens in less than 10 seconds, upward pressure would be applied to base section 2 at point 8, which is where contact 7 is located, to bring the opening time between 10 and 20 seconds.

I claim:

1. A circuit breaker comprising: a two piece metal enclosure, the two metal pieces thereof being electrical terminals and being insulated from each other, one of the metal pieces being a base and the other being a cover, the cover having a step at one end thereof; and a PMB bimetal disposed within the enclosure, the PMB bimetal comprising a cantilever section and a U shaped segment, the U shaped segment having a short leg and a long leg, one end of the cantilever section being fastened to the step, and the other end of the cantilever section being fastened to the short leg of the U shaped segment, and a contact fastened to the long leg of the U shaped segment for making electrical contact with a fixed contact fastened to the base, the cantilever section comprising a high expansion layer and a low expansion layer, the high expansion layer being in contact with the step at the end of the cover.

2. The circuit breaker of claim 1 wherein the inner surface of the U shaped segment comprises a high expansion layer and the outer surface thereof comprises a low expansion layer, the high expansion layer of the cantilever section being in contact with the low expansion layer of the U shaped segment.

* * * * *